US010294689B2

(12) United States Patent
Moore et al.

(10) Patent No.: US 10,294,689 B2
(45) Date of Patent: May 21, 2019

(54) POLE SETTING DEVICE AND METHOD OF USING THE SAME

(71) Applicant: Quanta Associates, L.P., Houston, TX (US)

(72) Inventors: Lucas Michael Moore, Kansas City, MO (US); Douglas Edward Simpson, Kansas City, MO (US); Lowell Wade Church, Kansas City, MO (US)

(73) Assignee: Quanta Associates, L.P., Houston, TX (US)

( * ) Notice: Subject to any disclaimer, the term of this patent is extended or adjusted under 35 U.S.C. 154(b) by 0 days.

(21) Appl. No.: 15/870,075

(22) Filed: Jan. 12, 2018

(65) Prior Publication Data

US 2018/0202183 A1 Jul. 19, 2018

Related U.S. Application Data

(60) Provisional application No. 62/446,210, filed on Jan. 13, 2017.

(51) Int. Cl.
*E04H 12/34* (2006.01)

(52) U.S. Cl.
CPC ..... *E04H 12/347* (2013.01); *E04H 12/345* (2013.01)

(58) Field of Classification Search
CPC ..... E04H 12/347; E04H 12/00; E04H 12/34; H01R 11/11; H01R 11/12; H01R 11/14; H01R 11/15; H02G 1/02; H02G 1/00
USPC ..... 174/45 R, 45 TD, 40 CC, 40 TD; 81/53.1; 294/174, 175; 414/23
See application file for complete search history.

(56) References Cited

U.S. PATENT DOCUMENTS

| | | | | |
|---|---|---|---|---|
| 951,341 | A | 3/1910 | Shelton et al. | |
| 1,410,380 | A | 3/1922 | Daniels | |
| 2,056,883 | A | 10/1936 | Brown | |
| 2,249,907 | A | 7/1941 | Perkowski | |
| 4,047,821 | A | 9/1977 | Hoke et al. | |
| 5,192,105 | A | 3/1993 | Walker | |
| 5,794,387 | A * | 8/1998 | Crookham | E04H 12/347 52/123.1 |
| 6,185,303 | B1 | 2/2001 | Losey | |
| 8,474,221 | B1 * | 7/2013 | Ceko | H02G 7/20 174/45 R |
| 8,910,431 | B2 * | 12/2014 | Egan | E04H 12/345 52/123.1 |

(Continued)

OTHER PUBLICATIONS

Blaine R. Copenheaver, PCT International Search Report, dated Apr. 4, 2018, 2 pages, ISA/US, Alexandria, Virginia, United States.

(Continued)

*Primary Examiner* — Angel R Estrada
(74) *Attorney, Agent, or Firm* — Oathout Law Firm; Mark A. Oathout; Antony C. Edwards

(57) ABSTRACT

The disclosure relates to a pole setting device to assist in setting a utility pole in a base while maintaining electrical isolation between the utility pole and a worker, the device having: a non-electrically conductive elongate member having a handle end and an opposite pole end, and having a length between the handle end and the opposite pole end; a bracket adapted to contact to an exterior surface of the pole and to the pole end of the non-electrically conductive elongate member.

27 Claims, 8 Drawing Sheets

(56) References Cited

U.S. PATENT DOCUMENTS

| | | | | |
|---|---|---|---|---|
| 9,238,922 | B2 * | 1/2016 | Intagliata | E04H 12/347 |
| 9,745,771 | B2 * | 8/2017 | Campbell | E04H 12/34 |
| 9,822,544 | B2 * | 11/2017 | Stevens | E04H 12/20 |

OTHER PUBLICATIONS

Blaine R. Copenheaver, PCT Written Opinion of the International Searching Authority, dated Apr. 4, 2018, 6 pages, ISA/US, Alexandria, Virginia, United States.

* cited by examiner

POLE SETTING DEVICE AND METHOD OF USING THE SAME

FIELD

Embodiments described herein generally relate to works on energized (live) electrical transmission lines and associated support structures. More particularly, embodiments described herein relate to a device and method for safely manipulating poles used to support electric power lines.

BACKGROUND

Electric power lines are held in their overhead position using support structures. The support structures typically include horizontal cross members or cross arms which are braced to, typically vertical, poles. The vertical poles may be made of wood, steel or concrete. To avoid downtime, maintenance and repair work may be carried out to the power lines and/or support structures when the power lines are energized.

Maintenance or repair work to the poles may include replacing old poles with new poles. Of course, new pole installations are also often needed. In both instances, the new pole being installed must be set in a base, such as in the ground. Since most pole installation work is done in the vicinity of energized power lines, there are safety concerns when an operator is installing new poles in such a setting. Safety concerns are heightened when the power lines carry voltages in the transmission-class (69 kV to over 500 kV).

Typically setting a pole involves the following procedure: a worker, standing on the ground, attaches a chain, cable or other tether to a new pole lying on the ground, and an operator operates a hoist or crane to lift the pole using the tether so as to suspend the pole above the ground, hopefully more or less vertically. The operator positions the lower end or butt of the pole over a hole which has been dug in the ground in the desired location of the pole. One or more workers, standing on the ground, manipulate the lower end of the pole as it is being set in the hole. New poles, during their setting, are not connected to energized transmission lines but are still inherently at least partially conductive due to induced electric fields generated by the energized transmission lines in the vicinity. The poles become more conductive if they are wet or dirty. In order to protect operators from touching the new poles being set and thus subjecting themselves to possibly injurious or fatal electric currents, the United States federal Occupational Safety and Health Administration (OSHA) has ruled that when a pole is set, moved, or removed near an exposed energized overhead conductor, the employer shall ensure that each employee wears electrical protective equipment or uses insulated devices when handling the pole and that no employee contacts the pole with uninsulated parts of his or her body.

For distribution-class voltages (typically 750 V to 34 kV), during setting, a worker on the ground is in close proximity to the pole. The lower end of the pole is typically manipulated by one or more workers wearing insulated rubber gloves. For transmission-class voltages, applicant is aware that in some instances one or more ropes are attached to the lower end of the pole and the pole is manipulated by one or more workers each holding the free end of one of the ropes at a distance from the pole.

However, continually reducing the possibility of accidents is desirable. One example of a potential accident is an operator who may lose control of a new pole being set, for example by having the tether attached too close to the pole's center-of-gravity so that the pole doesn't lift to the vertical but may teeter about the horizontal, risking contact with power lines, etc. when the pole is lifted to be set. In another example, upon lifting the pole, the end of the pole still in contact with the ground may simply roll, thus causing the entire pole to slightly change position while being held by the tether. In the event that the pole in either pole-setting situation, or another situation, accidentally contacts an energized electrical transmission line, the pole itself may then become energized. For transmission-class voltages, this may be particularly hazardous as the voltage or electrical potential may be sufficient to burn the rope (if rope is being used to manipulate the lower end of the pole) and may cause harm to the workers manipulating the pole. Even if the workers wear insulated rubber gloves while holding the free end of the rope, the gloves would likely not adequately insulate a person and provide protection from transmission class voltage levels.

Applicant is not aware of any physically and electrically isolating device that will provide workers on the ground with secure and positive control of the lower end of a new pole during the setting of the pole, for example where the pole is a transmission-class pole to support transmission class electrical conductors. While live line tools such as insulated grip-all clamp sticks for isolating workers from certain voltage classes do exist, improvement is desired.

Thus, there is a need for a device and method which would not only maintain a physical working distance between a worker on the ground, hereinafter also referred to as a "ground worker", and a potentially electrically conductive pole, but which would also electrically isolate the ground worker from the potentially conductive pole should it accidentally become energized.

SUMMARY

The disclosure relates to a pole setting device to assist in setting a utility pole in a base while maintaining electrical isolation between the utility pole and a worker, the device having: a non-electrically conductive elongate member having a handle end and an opposite pole end, and having a length between the handle end and the opposite pole end; a bracket adapted to contact to an exterior surface of the pole and to the pole end of the non-electrically conductive elongate member.

BRIEF DESCRIPTION OF THE DRAWINGS

FIG. 5*a* is a top view, FIG. 5*b* is a rear view and FIG. 5*c* is a side view; FIG. 6*a* illustrates the bracket of the pole setting device installed against an outer surface of a utility pole, FIG. 6*b* illustrates the pole end of the elongate member connected to the bracket, and FIG. 6*c* illustrates the handle end of the elongate member being gripped by an operator or worker.

DETAILED DESCRIPTION OF PREFERRED EMBODIMENTS

The pole setting device described herein has been primarily defined in the context of protecting a ground worker from electric shock during setting of a new pole in the vicinity of energized high voltage transmission lines. However, as one skilled in the art will understand, the device described herein may be used in any application which requires isolation of a ground worker from a potentially electrically conductive member such as distribution-class poles during the setting of the poles, which are typically made of wood.

The term "manipulation" as used herein may include the required steps carried out by a worker on the ground at the lower end of a pole during setting of the pole, either as a new pole or as a replacement of an old pole. Typically, such manipulation is relative to a base such as the ground. The pole may be located within the vicinity of electrically energized transmission lines.

As used herein, the term "worker" or "ground worker" relates to one or more persons standing on the ground at the work site and the term "operator" relates to one or more persons operating lifting mechanisms such as a crane or hoist at the work site.

FIGS. 1 to 5*c* illustrate various embodiments of a pole setting device 10. During use, the pole setting device 10 is mounted to a utility pole P such as best seen by way of example in FIGS. 6*a* to 6*c*. Device 10 physically and electrically isolates an operator or worker from the pole P during manipulation of the pole P so as to set the pole in its base.

Figure 1:
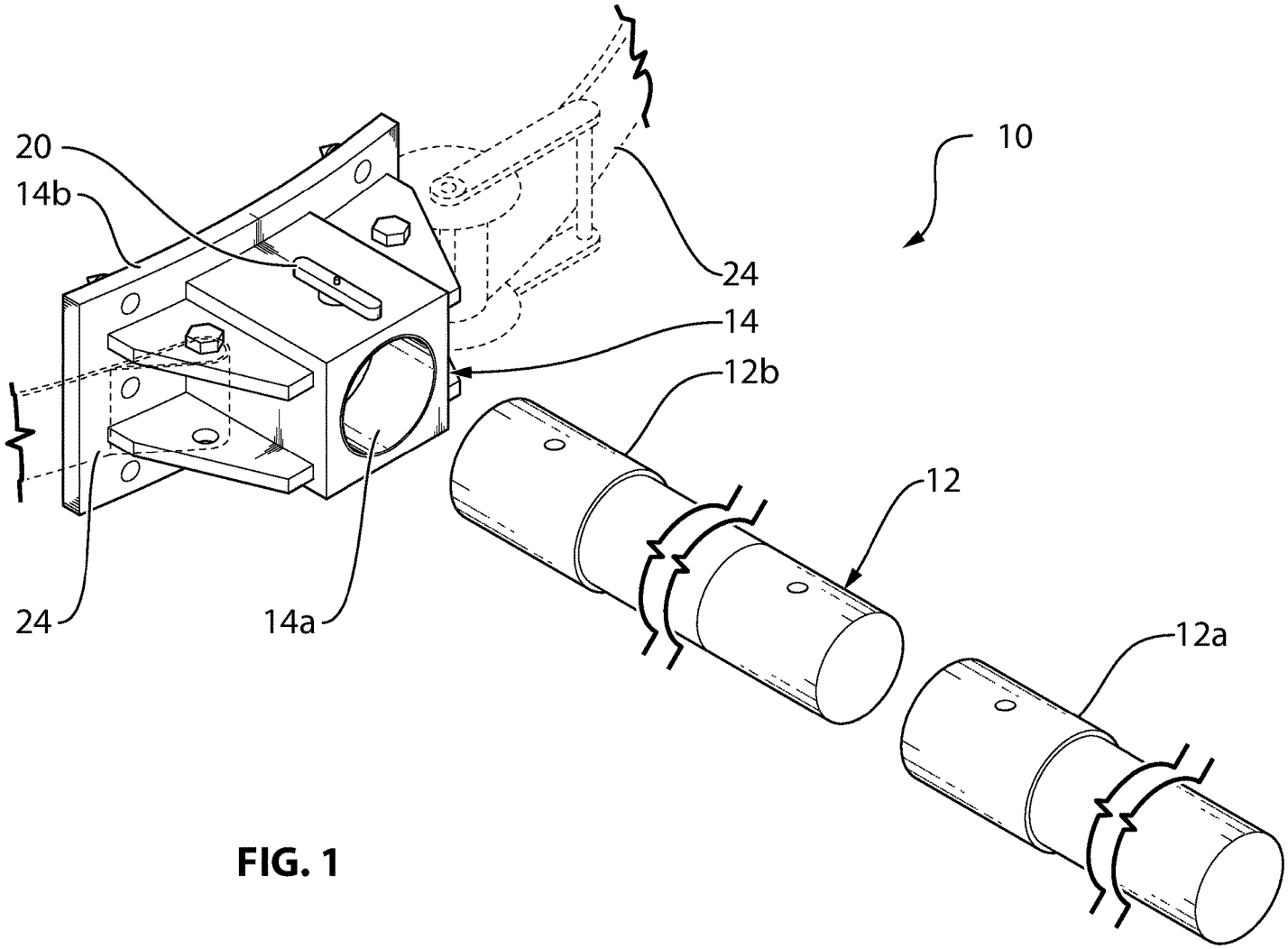
FIG. 1 is an exploded view of a pole setting device according to one embodiment, the view illustrating a bracket and a non-electrically conductive elongate member of the pole setting device.

In one embodiment, and with reference to FIG. 1, the pole setting device 10 includes a stick or rod, otherwise referred to herein as an elongate member 12. Pole setting device 10 also includes a bracket 14. The elongate member 12 is made of a non-electrically conductive or electrically insulating material such as fiberglass and comprises a human handle end or handle end 12*a* and an opposite end, a utility pole end or pole end 12*b*. The handle end 12*a* and the pole end 12*b* is separated by a length. The bracket 14 is releasably mounted onto the lower end of the utility pole P, for example by a strap 24*a*, and may be releasably coupled to, or may be permanently coupled to the pole end 12*b*. One embodiment of how bracket 14 may be adapted to releasably couple to an outer surface S of the pole P is shown by way of example in FIGS. 6*a* to 6*c* and is further described below. The bracket 14 comprises an integral connection interface or connect portion for coupling the bracket 14 to the pole end 12*b*. In one embodiment, the connect portion is a receiving socket or receiver or socket 14*a* and the bracket 14 is operatively coupled to the pole end 12*b* by locating the pole end 12*b* within the socket 14*a*. In one embodiment, the pole end 12*b* is retained or secured within the socket 14*a* by a locking device. For example, the pole end 12*b* may be retained by employing mounting pin 20 through hole H at pole end 12*b* while pole end 12*b* is inserted into socket 14*a*. The bracket 14 may further comprise a pole-contact face 14*b* which rests or engages against the outer or exterior surface S when the bracket 14 is mounted to the pole P. In one embodiment, the pole-contact face 14*b* is contoured such that it has a profile conforming to a profile of the exterior surface S of the pole so as to positively contact and rest against the exterior surface S when the bracket 14 is coupled to the pole P. During a setting operation, with the bracket 14 coupled to the lower end of pole P, which is the end of pole P closest to the surface of the ground, and with elongate member 12 coupled to the bracket 14, the pole P is controllable by the ground worker holding the handle end 12*a*, while the worker is maintained in physical and electrical isolation from the pole P. That is, even while the worker is holding handle end 12*a* of elongate member 12, he or she is electrically insulated from electrical current due to a voltage or electrical potential relative to pole P.

The elongate member 12 may be any device that permits a worker to manipulate pole P while at a distance remote from the pole P. Examples, not intended to be limiting, may include an electrically insulating rod, or an electrically insulating grip-all clampstick, a so-called hot-stick or shotgun as they are known in the industry. Coupling between the bracket 14 and the elongate member 12 may attain various configurations depending on the structural configuration of the pole end 12*b* of the elongate member 12. Accordingly, the connect portion of the bracket 14 need not be a socket 14*a* and may be a different structure, such as an eye on the bracket (for use if, for example, the rod is a grip-all clampstick) that enables coupling between the bracket 14 and the pole end 12*b*.

Figure 6A:
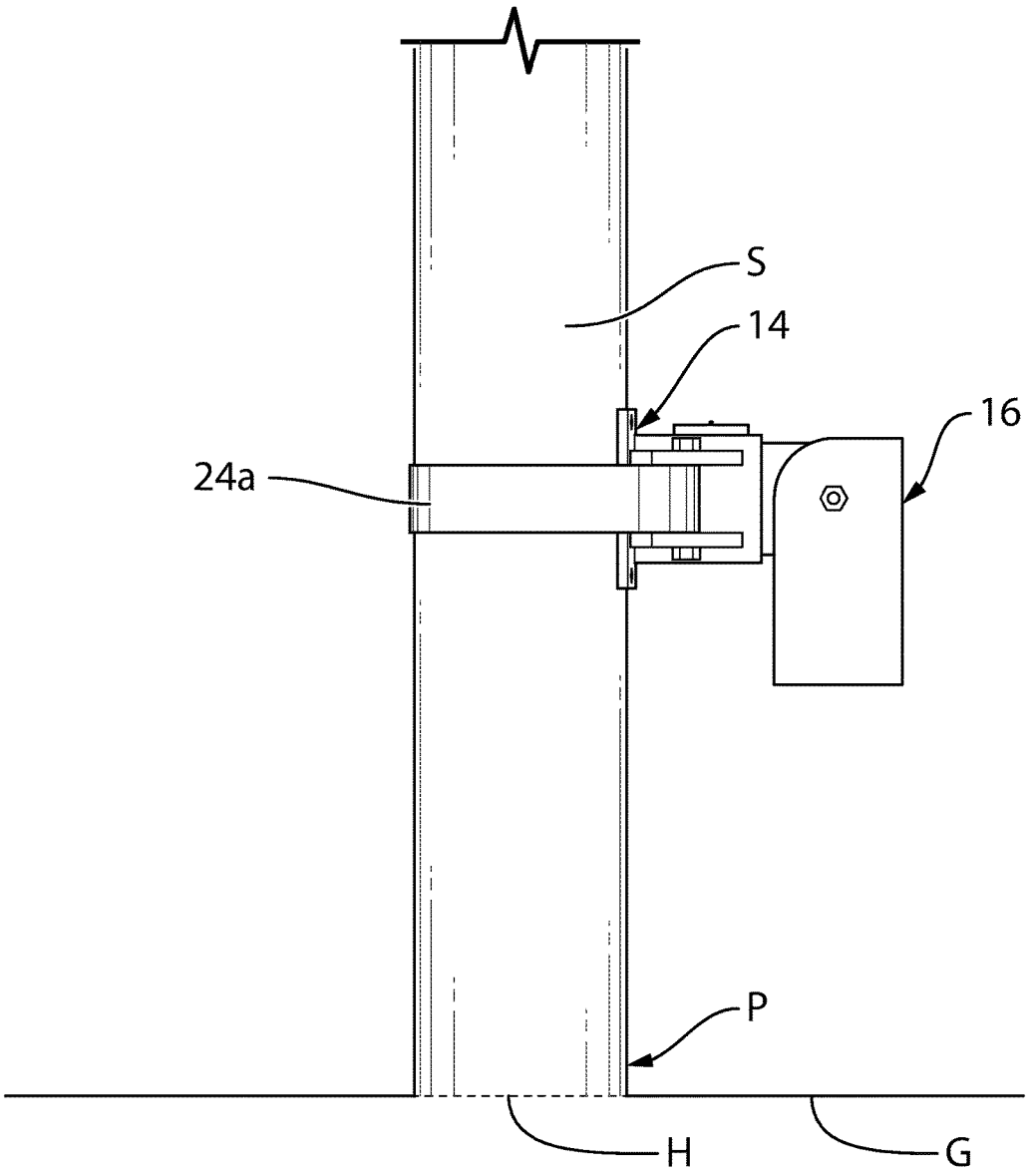
FIGS. 6*a* to 6*c* are views illustrating the pole setting device in its operative position.
Figure 6B:
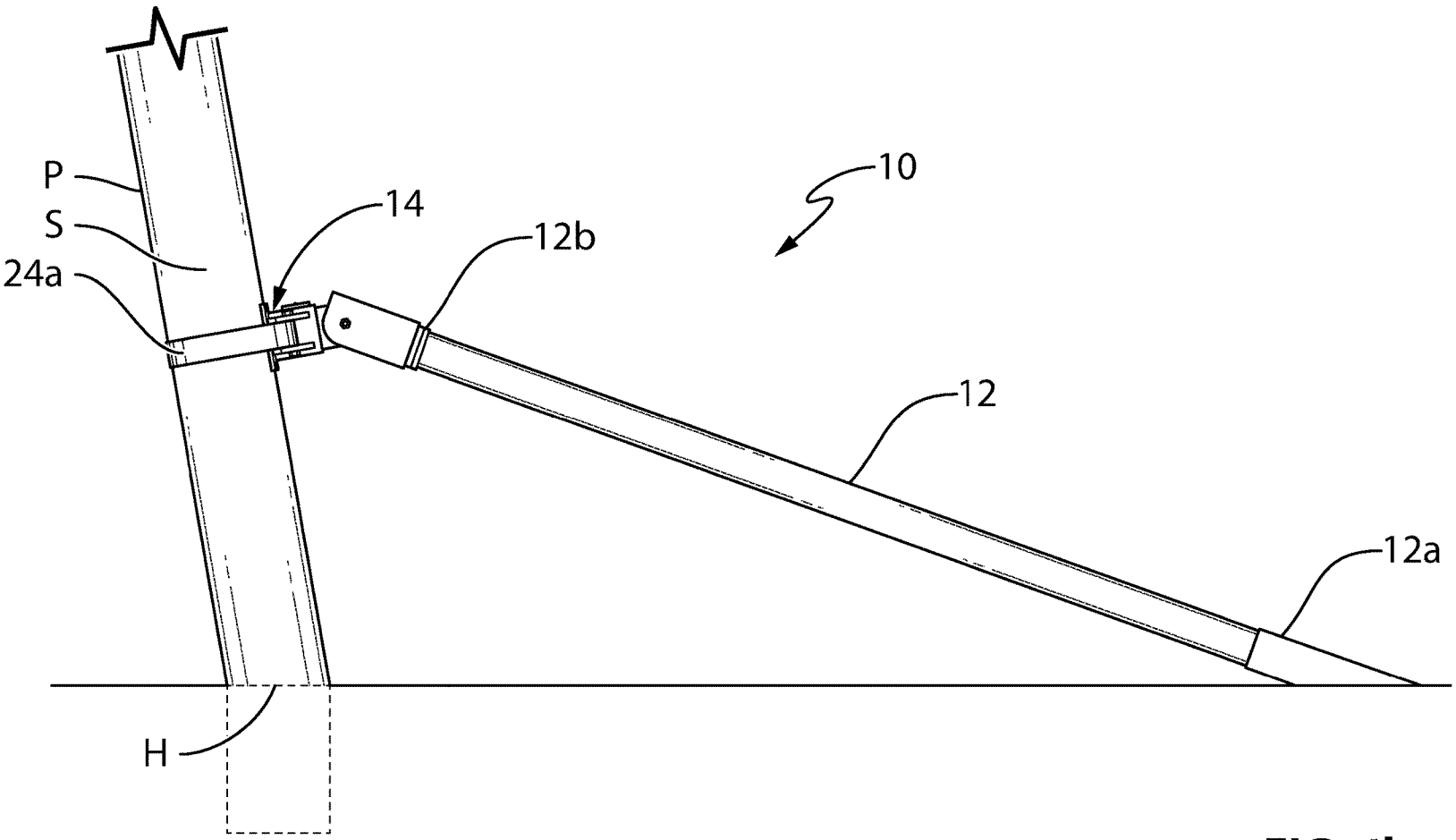
Figure 6C:
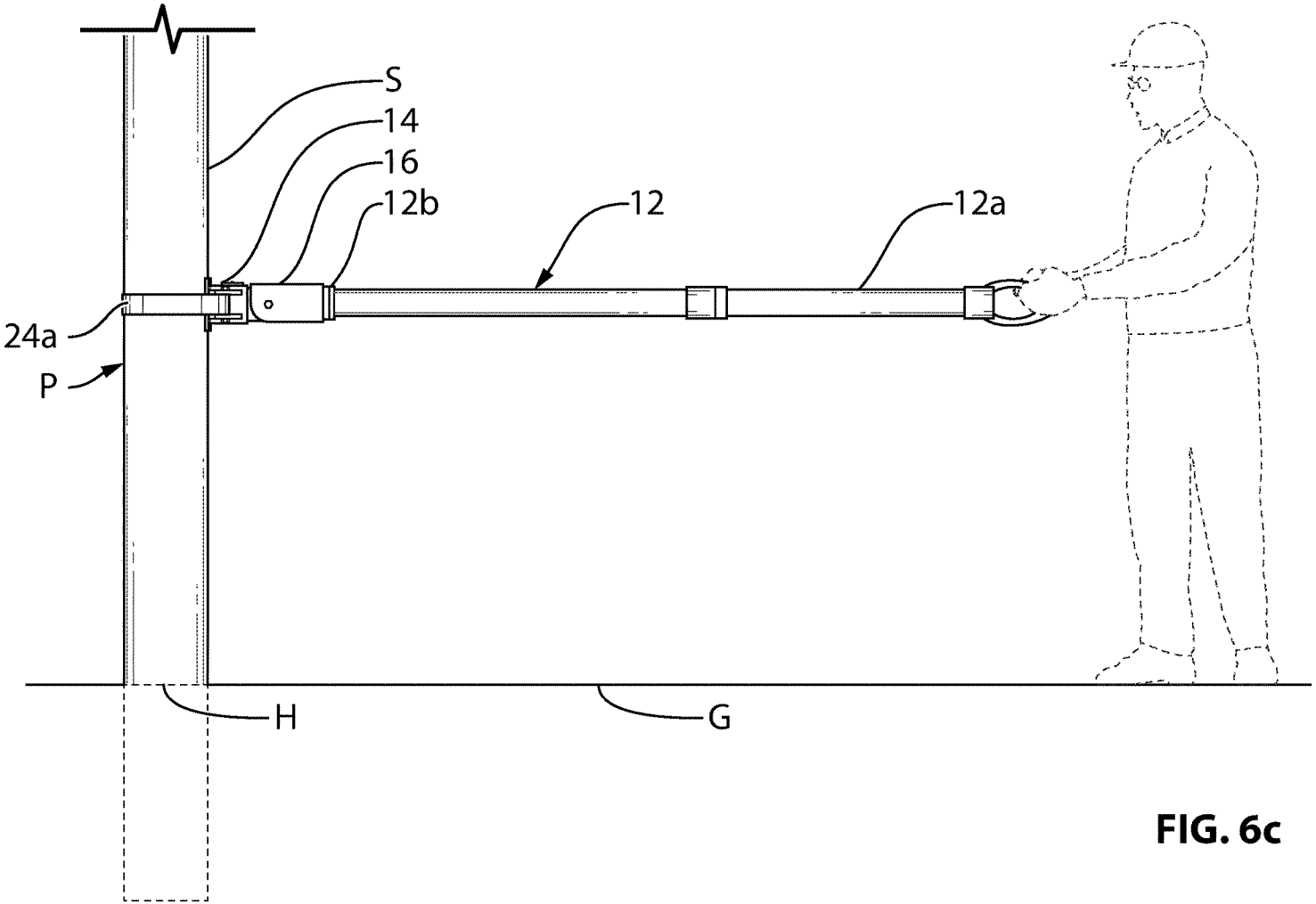

In one embodiment, not intended to be limiting, the pole setting device 10 comprises a bracket 14 made of aluminum that attaches to the pole P, while elongate member 12 couples to the bracket 14. Bracket 14 may be made of a material of suitable strength and rigidity that provides a bracket 14 that is also relatively light in weight, which is why aluminum is suitable. A high-strength electrically non-conducting material also may be used. In one embodiment, the length of the elongate member 12 may be adjustable, for example by having sections which mount to one-another such that elongate member 12 may be a customized length depending upon the pole being set, and surrounding electrical power line voltages. The worker holds the handle end 12*a* to manipulate and control the pole P while setting the lower end of the pole P in the base, such as ground G, thus keeping the worker's body at a physical working distance, approximately equal to the length L of the elongate member 12, from the pole P (FIG. 6*c*). Since elongate member 12 is made substantially entirely of an insulating material, the worker is also electrically isolated in case of accidental contact of pole P with energized electrical transmission lines (not shown).

Figure 2:
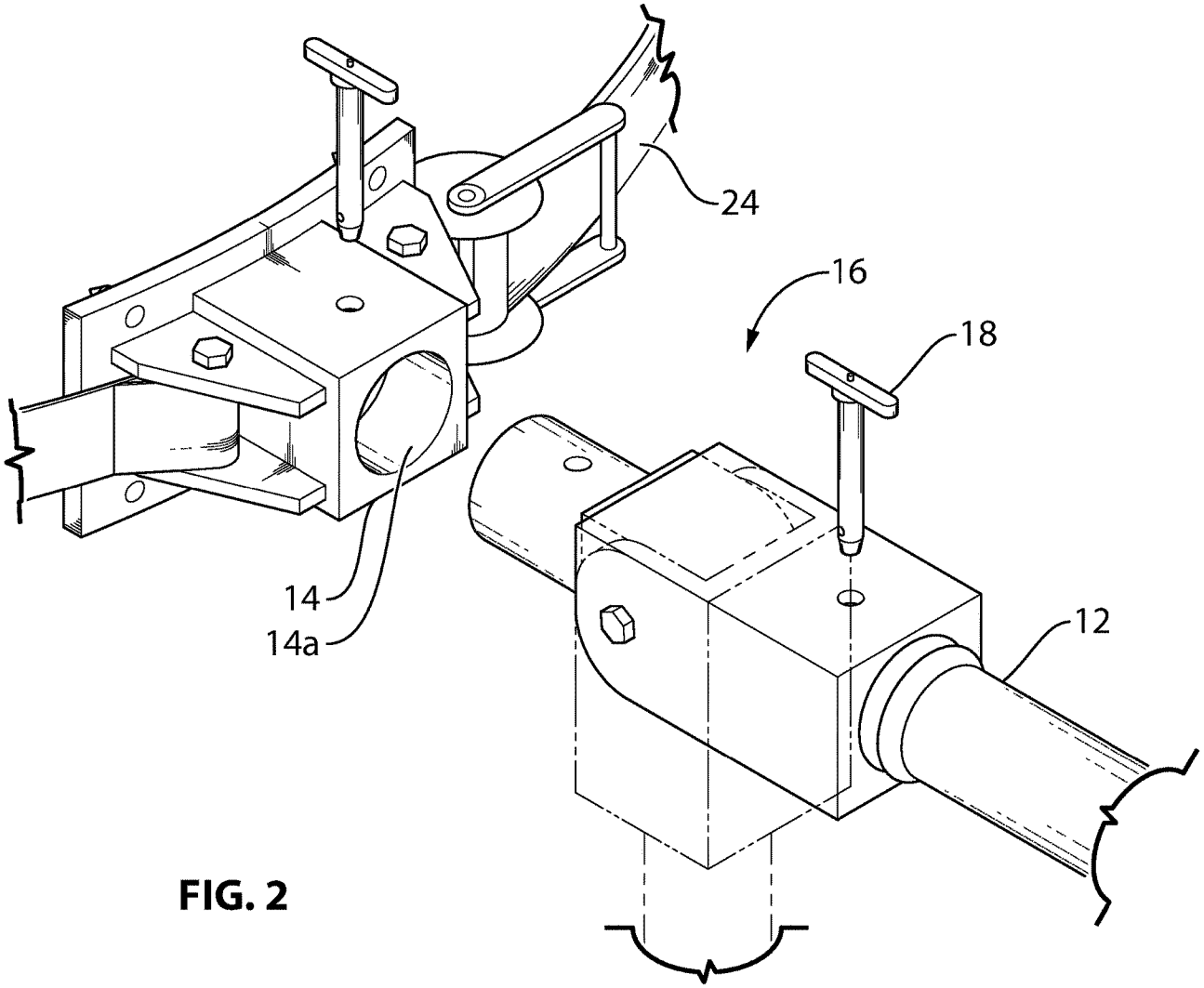
FIG. 2 is a partial exploded view of a pole setting device according to another embodiment, the view illustrating a bracket and a non-electrically conductive elongate member of the pole setting device.
Figure 3:
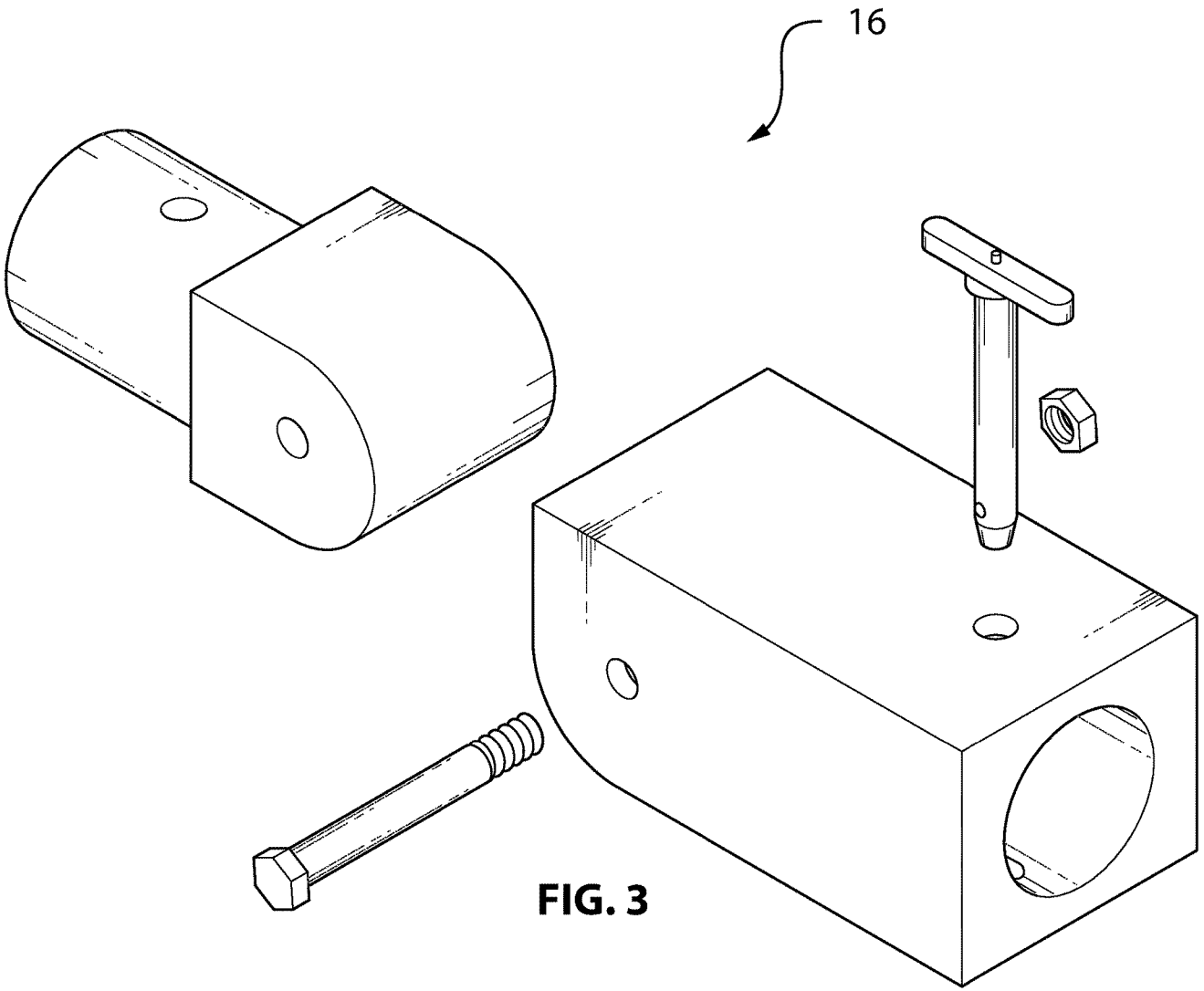
FIG. 3 is an exploded view of a swivel or pivot or hinge assembly associated with the elongate member of FIG. 2.
Figure 4:
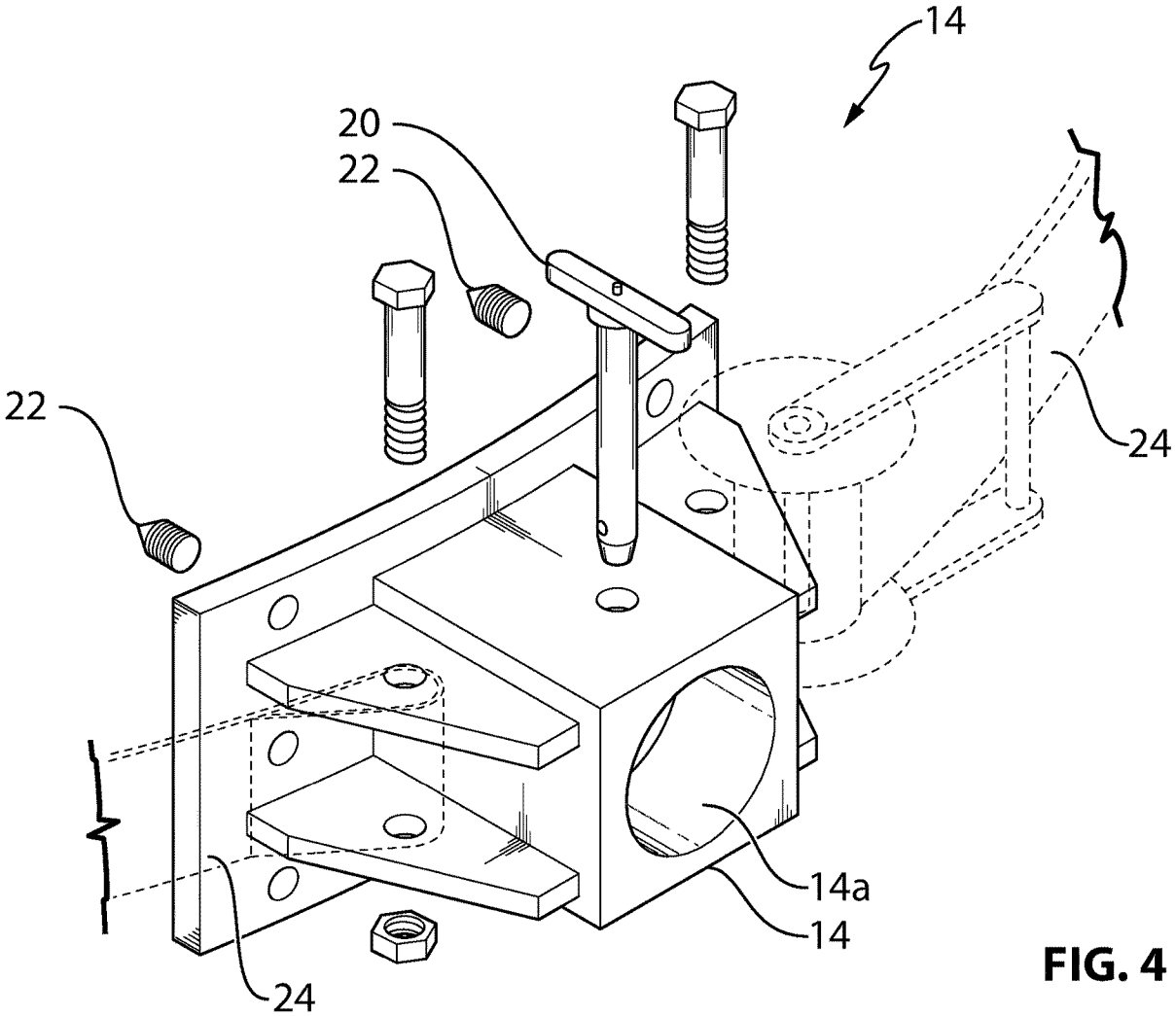
FIG. 4 is a detailed perspective view of the bracket of the pole setting devices depicted in FIGS. 1 and 2.
Figure 5B:
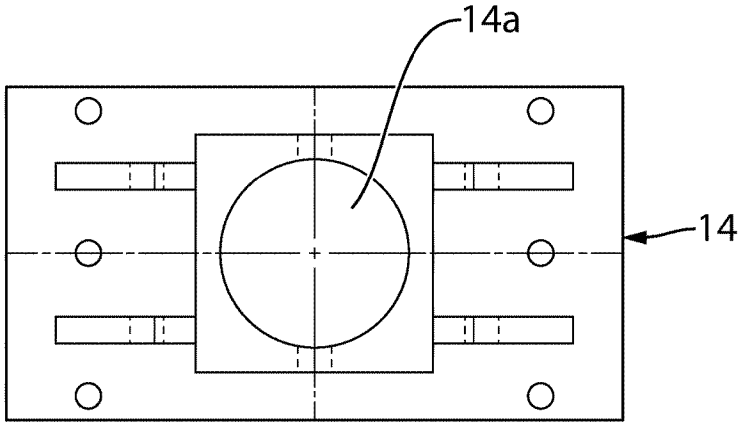
FIGS. 5*a* to 5*c* are various views of the bracket of FIG. 4.
Figure 5A:
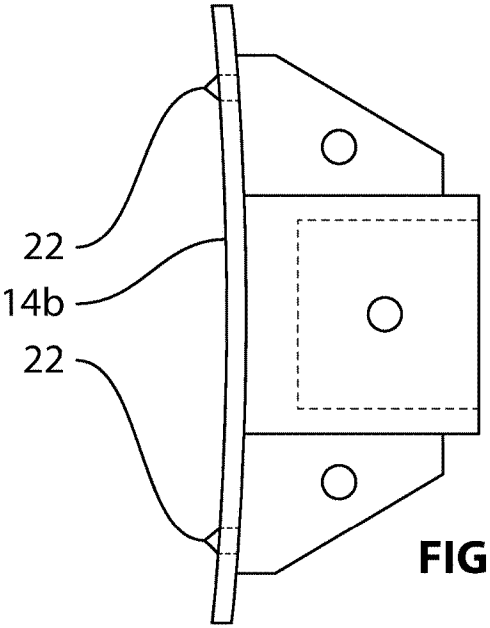
Figure 5C:
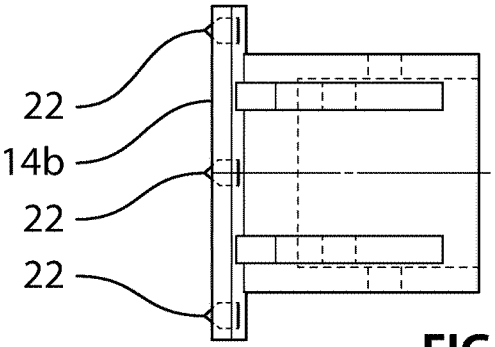

In one embodiment, such as that depicted in FIG. 2, the bracket 14 is rotatably or pivotally coupled to the pole end 12*b*. A pivotal connection allows the worker to positively control or position the pole P as the pole P is being raised to its vertical position and then lowered into a hole H within base G. FIG. 3 illustrates details of an articulated joint 16 which may be mounted in or on the bracket 14. As seen in FIG. 3, pole end 12*b* of the elongate member is mounted and retained in the articulated joint 16 using mounting pin 18 journaled in corresponding holes, and the pole end 12*b* with the joint 16 attached is retained in the socket 14*a* of the bracket 14 using mounting pin 20 journaled in corresponding holes. Joint 16 allows the elongate member 12 to rotate for example 90 degrees relative to the bracket 14, for example, to rotate up and down from horizontal by control a ground worker when the pole P is vertical and being raised or lowered by the operator of a crane.

As one skilled in the art will understand, the joint 16 illustrated in the accompanying drawings is an example. The rotatable or pivotable action may be attained by using any articulating joint or coupling that enables movement of the elongate member 12 about or relative to the bracket 14 as the pole P is, for example, being translated from its resting, horizontal position to its operative, vertical position, and, once vertical, during raising and lowering of the pole P above the hole H in the ground (FIGS. 6*a*-6*c*).

Also, as one skilled in the art will understand, the elongate member 12 and the bracket 14 may be coupled in a non-pivotal or fixed arrangement as shown in FIG. 1.

In one embodiment, in the event the pole P is made of wood, in order to increase gripping contact between the bracket 14 and the pole P, the pole-contact face 14*b* of the bracket 14 may be fitted with teeth 22 or serrations to bite into or otherwise frictionally or positively engage and penetrate into the exterior surface S of the pole P. In the embodiment illustrated in FIG. 4, the teeth 22 are threadably mounted to the bracket 14 so as to protrude from the pole-contact face 14*b* of the bracket 14. As one skilled in the art will understand, teeth 22 or serrations may not be advantageous if the pole setting device 10 is to be installed on a steel, concrete or other pole without a penetratable surface, in which case other frictions enhancing means may be employed.

In order to secure a releasable attachment between the bracket 14 and the pole P, a clamping member 24 is provided which cooperates between the bracket 14 and the utility pole P to couple the bracket 14 to the utility pole P. Specifically, the clamping member 24 clamps the bracket 14 to the exterior surface S of the pole P. In one embodiment, not intended to be limiting, the clamping member 24 is a ratcheting and adjustable clamp that is integral to the bracket 14 and which includes at least one pole-encircling member. Examples of pole-encircling members, not intended to be limiting, may include a strap such as ratchet strap 24*a* seen in the accompanying drawings or, a ring shaped member, or any such member that holds bracket 14 on pole P and that prevents dislodgement of the bracket 14 from the pole P during operation and which is releasable from the pole once the pole is set. Ratchet strap 24*a*, in one embodiment, may be a flexible strap whose opposite ends are connected to the bracket 14 and whose length may be adjusted by the clamping member 24. Ratchet strap 24*a* may be fabricated from a material that is cotton, or a cotton blended with a synthetic material such as nylon. Generally, cotton will provide some degree of grip and friction to prevent sliding of ratchet strap 24*a* relative to pole P, while a synthetic material will provide strength greater than cotton. Still yet, ratchet strap may be entirely a synthetic material.

In one embodiment, the pole end 12*b* is a male end that inserts into the socket 14*a* in the bracket 14. Length L of the elongate member 12 may be adjusted using various cooperating couplers having mating male/female ends. Alternatively, elongate member 12 may be telescopic. Typically, the elongate member 12 may be, for example, eight feet (about 243.84 cm) or six feet (about 182.88 cm) or four feet (about 121.92 cm) in length. However, the elongate member 12 may be configured to attain any reasonable length depending on applicable power line voltages and required working distances in order to satisfy applicable safety stand-off requirements, also known as limit of approach requirements. In one embodiment, the length of the non-electrically conductive elongate member 12 is determined by the voltage in an energized electrical conductor that is located at a distance from the handle end 12*a* of the non-electrically conductive elongate member 12 that is less than a length of the utility pole P.

The following paragraph describes use of the pole setting device 10. Various operative positions of the pole setting device 10 are depicted in FIGS. 6*a* to 6*c*. The pole P illustrated in FIGS. 6*a* to 6*c* is a transmission-class support pole. Although teachings of the present invention permit employing one pole setting device 10 during the setting of a pole P, depending upon the size and weight of the pole to be set, in another embodiment, two of bracket 14 may be attached to the pole P while it is lying on a base such as ground G. Preferably, the brackets are mounted at or near the ground line or base end (the lower end) of the pole. For example, for a ninety foot pole that is intended to be set eleven feet in the ground G, the two brackets 14 may be installed near the eleven foot mark from the butt end of the pole P, which is that end of the pole P intended to be placed into the ground. After the brackets are mounted onto pole P, an elongate member 12 is installed onto each bracket 14 by mating each pole end 12*b* into a socket 14*a* (FIG. 6*b*). Once the elongate members 12 are installed, the pole P is raised by an operator using a lifting mechanism such as a hoist or a crane or a digger truck (not shown). While the pole P is being raised, two workers on the ground, each controlling a pole setting device 10 and spaced apart from one another, together control the butt end of the pole P by firmly holding a corresponding handle end 12*a* of the elongate member 12. Since one handle is held by each ground worker, and since the handles 12*a* are spaced from the pole P, the ground workers are also consequently located at a safe distance from the pole P and spaced from one another to brace the base end of the pole P for installation into the hole H of ground G. Also, since the elongate members 12 are made of an electrically insulating material, the workers are also electrically isolated from pole P.

The workers control the pole P as it is being raised by each holding onto a handle end 12*a*. The joint 16 on each bracket 14 allows the handle 12*a* to swivel or pivot downwardly as the pole P is being raised, and then rotated upwardly, for example to horizontal, as the butt end of pole P is lowered into a receiving hole H in the ground G. Thus the ground workers may control and manipulate the butt end of the pole P without contacting the pole P.

If the pole is sufficiently light such as a distribution-class support pole, a single ground worker may manipulate the pole using only a single bracket 14 and elongate member 12.

As one of skilled in the art will recognize, size and location of the bracket 14 may depend on factors including: the diameter of the pole, the weight of the pole, and the length of the pole or depth at which the pole is required to be installed in the base, such as the ground.

The pole setting device 10 described herein protects a ground worker from hazardous differences in electrical potential by locating the ground worker at a working distance from the pole P and electrically isolating the worker from the pole P. If an operator of a crane were to accidentally allow a pole to contact an energized electrical conductor, the pole may become energized and thereby conduct electrical energy along its length so that the butt end becomes energized and passes electricity to ground. However, if the ground worker were controlling the pole using the pole setting device described herein, he would be electrically isolated from the pole and standing some safe distance from the point at which the pole contacts the earth. The combination of electrical isolation and distance from the pole prevents the ground worker from experiencing electrical shock should the pole become electrically energized.

What is claimed is:

1. A pole setting device to assist in setting a utility pole in a base while maintaining electrical isolation between the utility pole and a worker, the device comprising:

a non-electrically conductive elongate member having a handle end and an opposite pole end, and having a length between the handle end and the opposite pole end;

a bracket having a first side and a second side, the first side defining a pole-contact face that has a profile conforming to a profile of an exterior surface of the pole and which is adapted to conformally contact the exterior surface of the pole, the second side defining a connect portion which is adapted to receive the pole end of the elongate member so as to couple the elongate member to the bracket and allow upward and downward pivotal movement of the elongate member when the elongate member is coupled to the bracket; and a pole-encircling member which is integral to the bracket.

2. The pole setting device of claim 1, wherein the connect portion is a socket and the elongate member is coupled to the bracket by locating the pole end within the socket.

3. The pole setting device of claim 1, further comprising a clamp cooperating between the bracket and the pole to couple the bracket to the pole, and wherein the clamp is integral to the bracket.

4. The pole setting device of claim 3, wherein the clamp is an adjustable clamp and includes the pole-encircling member, and wherein the pole-encircling member is flexible.

5. The pole setting device of claim 4, wherein the pole-encircling member is a strap.

6. The pole setting device of claim 1, wherein the length of the conductive elongate member is adjustable.

7. The pole setting device of claim 1, wherein the elongate member is made of fiberglass.

8. The pole setting device of claim 1, wherein the bracket is made of aluminum.

9. The pole setting device of claim 1, wherein the pole-contact face has serrations or teeth to grip the exterior surface of the pole.

10. The pole setting device of claim 1, wherein the elongate member is an insulating rod.

11. The pole setting device of claim 1, wherein the bracket is electrically non-conductive.

12. The pole setting device of claim 1, wherein the length of the elongate member is in the range of substantially four to eight feet.

13. A method for manipulating a utility pole relative to a base, the method comprising:

(a) providing a pole setting device comprising a non-electrically conductive elongate member having a handle end and an opposite pole end, and having a length there-between, a bracket having a first side and a second side, the first side defining a pole-contact face that has a profile conforming to a profile of an outer surface of the pole and which is adapted to conformally couple to the outer surface of the pole, the second side defining a connect portion which is adapted to receive the pole end of the elongate member so as to couple the elongate member to the bracket and allow upward and downward pivotal movement of the elongate member when the elongate member is coupled to the bracket, and a pole-encircling member which is integral to the bracket;

(b) mounting the bracket to the outer surface of the pole adjacent a base end of the pole; and (c) gripping the handle end and manipulating the base end of the pole so as to set it in the base.

14. The method of claim 13, wherein the mounting step further comprises: mounting the bracket by locating the pole-contact face of the bracket against the outer surface of the pole; locating the pole end of the elongate member within the connect portion so as to couple the elongate member to the bracket and thereby space the handle end of the elongate member from the pole.

15. The method of claim 13 further comprising mounting the bracket onto the pole while the pole is resting on the base, and, using the pole setting device to control the pole while the pole is being raised from the base.

16. The method of claim 15 further comprising raising the pole using a lifting mechanism so as to suspend the pole vertically.

17. A device to assist in setting a utility pole in a ground hole, the device comprising:

a non-electrically conductive elongate member having a human handle end and a utility pole end, and a length from the human handle end to the utility pole end;

a bracket located at the utility pole end, the bracket having a first side and a second side, the first side defining a pole-contact face that has a profile conforming to a profile of an exterior surface of the pole and which is adapted to conformally contact the exterior surface of the pole, the second side defining a connection interface which is adapted to receive the pole end of the elongate member so as to couple the elongate member to the bracket and allow upward and downward pivotal movement of the elongate member when the elongate member is coupled to the bracket; and a pole-encircling member which is integral to the bracket.

18. The device of claim 17, further comprising a ratcheting mechanism which is integral to the bracket and which includes the pole-encircling member, and wherein the pole-encircling member is a flexible strap whose length is adjustable by the ratcheting mechanism, opposite ends of the flexible strap connected to the bracket.

19. The device of claim 17, further comprising a locking device integral to the connection interface for securing the elongate member to the bracket when the pole end is located within the connection interface.

20. The device of claim 17, wherein the pole-contact face has serrations or teeth to grip the exterior surface of the utility pole.

21. The device of claim 17, wherein the connection interface includes a receiving socket and the elongate member is coupled to the bracket by locating the pole end within the receiving socket.

22. The device of claim 17, further comprising a clamp cooperating between the bracket and the utility pole to couple the bracket to the utility pole.

23. The device of claim 22, wherein the clamp is a ratcheting and adjustable clamp which includes the pole-encircling member.

24. The device of claim 23, wherein the pole-encircling member is a flexible strap.

25. The device of claim 17, wherein the length of the elongate member is adjustable.

26. The device of claim 17, wherein the bracket is non-electrically conductive.

27. The device of claim 17, wherein the length of the elongate member is determined by the voltage in an energized electrical conductor that is located at a distance from the human handle end of the non-electrically conductive elongate member that is less than a length of the utility pole.

* * * * *